US008206181B2

(12) United States Patent
Steijner

(10) Patent No.: US 8,206,181 B2
(45) Date of Patent: Jun. 26, 2012

(54) CONNECTOR ARRANGEMENT

(75) Inventor: Johan Magnus Rikard Steijner, Löddeköpinge (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/431,798

(22) Filed: Apr. 29, 2009

(65) Prior Publication Data

US 2010/0279554 A1 Nov. 4, 2010

(51) Int. Cl.
*H01R 24/04* (2006.01)

(52) U.S. Cl. ..... 439/669; 439/668; 439/675

(58) Field of Classification Search ..... 439/675, 439/668, 669, 944, 489
See application file for complete search history.

(56) References Cited

U.S. PATENT DOCUMENTS

| | | | | |
|---|---|---|---|---|
| 4,420,216 | A | 12/1983 | Motoyama et al. | |
| 6,461,199 | B1 * | 10/2002 | Koga et al. | 439/668 |
| 6,672,913 | B1 * | 1/2004 | Wang | 439/874 |
| 6,869,316 | B2 | 3/2005 | Hinkle et al. | |
| 6,981,895 | B2 | 1/2006 | Potega | |
| 7,458,853 | B2 | 12/2008 | Omura et al. | |
| 2004/0132344 | A1 | 7/2004 | Plishner | |
| 2007/0077818 | A1 | 4/2007 | Iwakawa | |
| 2008/0009198 | A1 * | 1/2008 | Marino | 439/668 |
| 2008/0090465 | A1 * | 4/2008 | Matsumoto et al. | 439/669 |
| 2009/0061694 | A1 * | 3/2009 | Kawasaki et al. | 439/669 |
| 2009/0311915 | A1 * | 12/2009 | Stiehl | 439/669 |
| 2010/0112871 | A1 * | 5/2010 | Yin | 439/669 |
| 2010/0203767 | A1 * | 8/2010 | Zhang | 439/660 |

FOREIGN PATENT DOCUMENTS

| | | |
|---|---|---|
| DE | 20 2004 006 906 | 10/2004 |
| WO | 96/02888 | 2/1996 |

* cited by examiner

*Primary Examiner* — Hien Vu
(74) *Attorney, Agent, or Firm* — Peter F. Corless; Steven M. Jensen; Edwards Wildman Palmer LLP

(57) ABSTRACT

A connector arrangement is provided comprising an elongate member with a tip end and a base end. The elongate member has at least one ring area electrically insulated from the remaining surface of the elongate member. In the ring area, at least a first contact element and a second contact element electrically insulated from each other are provided. At least a portion of a boundary between the first contact element and the second contact element runs in a direction forming a non-zero angle with a boundary of the ring area.

13 Claims, 4 Drawing Sheets

CONNECTOR ARRANGEMENT

FIELD OF THE INVENTION

The present invention relates to connector arrangements.

BACKGROUND OF THE INVENTION

Connectors and connector arrangement are commonly used to electrically connect two devices with each other. One type of connectors are audio connectors which are for example used to connect headphones or loudspeakers to audio equipment, for example portable or non-portable audio equipment, cell phones, personal computers, and the like. Commonly used audio connectors include 6.35 mm, 3.5 mm or 2.5 mm audio connectors. The male form of such audio connectors usually comprise a generally elongate member with different areas of the circumferential surface being electrically insulated from each other to provide a plurality of contacts. Conventional arrangements of such contacts are referred to as TS (Tip Sleeve), TRS (Tip Ring Sleeve) or TRRS (Tip Ring Ring Sleeve) connectors, indicated that a tip contact is insulated from a sleeve contact which is generally adjacent to the head, with no, one or two so-called ring contacts in between. For example, a TS connector may be used for mono audio, a TRS connector may be used for stereo audio and a TRRS connector may be used for stereo audio with an additional signal, for example a video signal.

Corresponding female connectors to the above-described male audio connectors may have an elongate hole with contact elements arranged therein corresponding to the positions of the insulated areas mentioned above.

These audio connectors have a basically standardized shape, such that for example headphones manufactured by one manufacturer may be used with portable audio equipment like a MP3 player from another manufacturer.

Besides female audio connectors, many audio devices have further connectors for further purposes, for example an antenna connector, a power connector, a data connector and the like. Such a plurality of connectors sometimes makes it difficult for a user to use the device since each device, cable or the like has to be plugged into the right connector. In case a device like loudspeakers or headphones are provided with additional functions, such a device may have more than one connector, for example to receive audio signals and power from the audio device, which makes connecting the device with the audio device somewhat inconvenient.

Therefore, there is a general need for improved connector arrangements offering more flexibility.

SUMMARY

According to an embodiment, a connector arrangement is provided, comprising:

an elongate member with a tip end and a sleeve end, said elongate member comprising:

at least one ring area electrically insulated from the remaining surface of the elongate member, said at least one ring area comprising at least a first contact element and a second contact element electrically insulated from each other, wherein at least a portion of an insulation between the first contact element and the second contact element runs in a direction forming a non-zero angle with a direction of a boundary of the at least one ring area.

According to an embodiment, the elongate member may have the form of a standard audio connector.

The standard audio connector may be selected from the group consisting of a 3.5 mm audio connector, a 2.5 mm audio connector and a 6.35 mm audio connector.

According to an embodiment, said at least one ring area may comprise a plurality of ring areas.

According to an embodiment, said plurality of ring areas may comprise a first ring area, a second ring area and a third ring area, said third ring area being arranged at said sleeve end of said connector to form a sleeve area, each of said first ring area, second ring area and third ring area comprising a first contact element and a second contact element.

According to an embodiment, the connector may further comprise a tip contact at said tip end.

According to an embodiment, said elongate member may comprise a first conducting element defining said first contact element, a second conducting element defining said second contact element, and an insulating material filling gaps between said first conducting element and said second conducting element.

Said first conducting element and said second conducting element may each comprise at least one ring-shaped portion.

According to an embodiment, the connector may further comprise a guiding element configured to aid an insertion of the connector arrangement into a receptacle with a defined orientation.

The guiding element may comprise at least one element selected from the group consisting of a protrusion, a ridge, a slit and a groove.

According to another embodiment, a receptacle for a connector arrangement is provided, comprising:

an elongate hole, at least two contacts arranged within a ring section of said elongate hole to connect first and second contact elements of a matching connector arrangement, said first and second contact element being arranged within a ring section of said connector.

According to an embodiment, the receptacle may further comprise a guiding element configured to provide a defined orientation for the insertion of the connector arrangement into the receptacle.

Said guiding element of said receptacle may comprise at least one element selected from the group consisting of a cut-out, a ridge, a groove, a slit and a protrusion.

According to an embodiment, the receptacle may further comprise a sensor configured to detect coupling of a further guiding element of a connector arrangement with said guiding element.

According to a further embodiment, a method for manufacturing a connector is provided, comprising:

providing a first conducting element defining a first contact element, providing a second conducting element defining a second contact element, placing said first conducting element and said second conducting element in a molding form such that said first contact area and said second contact area are positioned within a ring area, wherein a portion of a boundary between the first contact area and the second contact area runs in a direction forming a non-zero angle with a boundary of the ring area, and filing an insulating material between said first conducting element and said second conducting element using a molding technique.

It is to be noted that the above-mentioned embodiments and features may be combined with each other unless specifically noted to the contrary. Furthermore, it should be noted that other embodiments may comprise fewer, alternative and/or additional features compared to the ones described above.

DETAILED DESCRIPTION OF THE INVENTION

Figure 1:
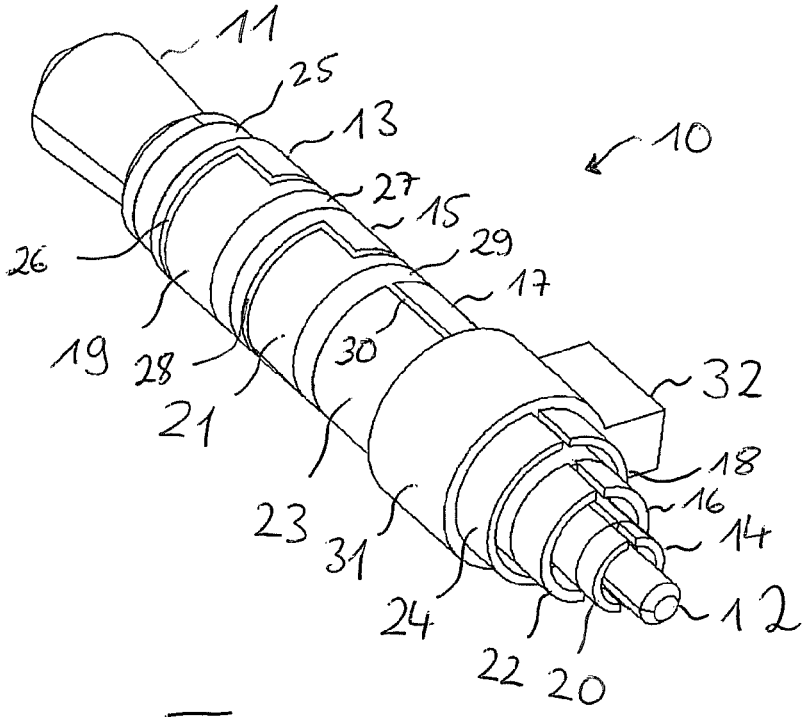
FIG. 1 is a perspective view of a connector arrangement according to an embodiment of the present invention.

In the following, various embodiments of the present invention will be described in detail with reference to the accompanying drawings. It is to be understood that the following description and drawings are given only for the purpose of illustration and are not to be taken in a limiting sense.

It is to be understood that in the drawings various elements are depicted in a manner to give a clear understanding of the respective embodiment to a person skilled in the art and are not necessarily drawn to scale. Also, different figures, although showing the same elements, are not necessarily to scale with each other. Moreover, any directional terminal like "left", "right", "top", "bottom", "up" or "down" is merely used to indicate certain elements in the drawings and is not to be construed as indicating any preferential orientation of the actual embodiments of connector arrangements described hereinafter, since these may be orientated in any desired direction.

It should be noted that describing an embodiment comprising a plurality of specific elements is not to be construed as indicating that all these elements are necessary for practicing the present invention. Instead, in other embodiments fewer elements may be provided.

The scope of the invention is not intended to be limited by the embodiments described hereinafter, but is intended to be limited only by the appended claims and equivalents thereof.

Figure 2:
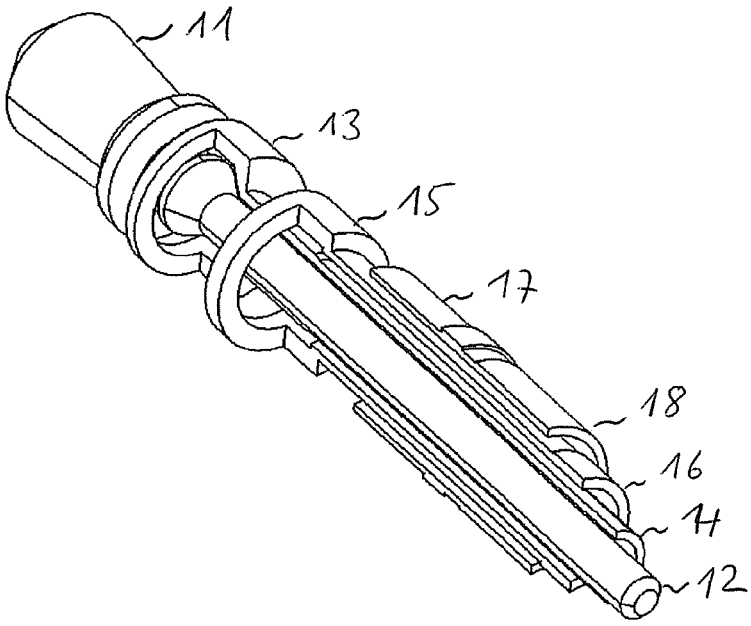
FIG. 2 is a perspective view of conducting portions of the embodiment of FIG. 1.
Figure 3:
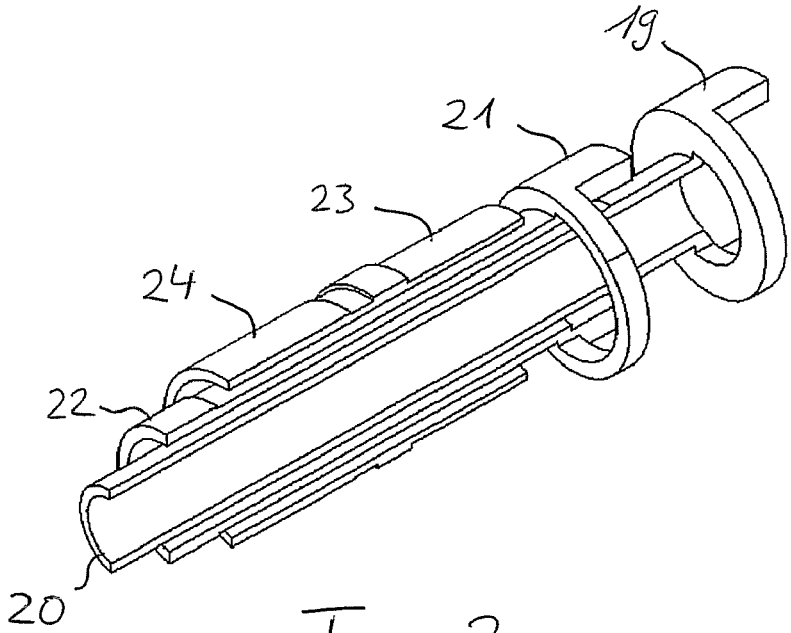
FIG. 3 is a perspective view of further conducting portions of the embodiment of FIG. 1.
Figure 4:
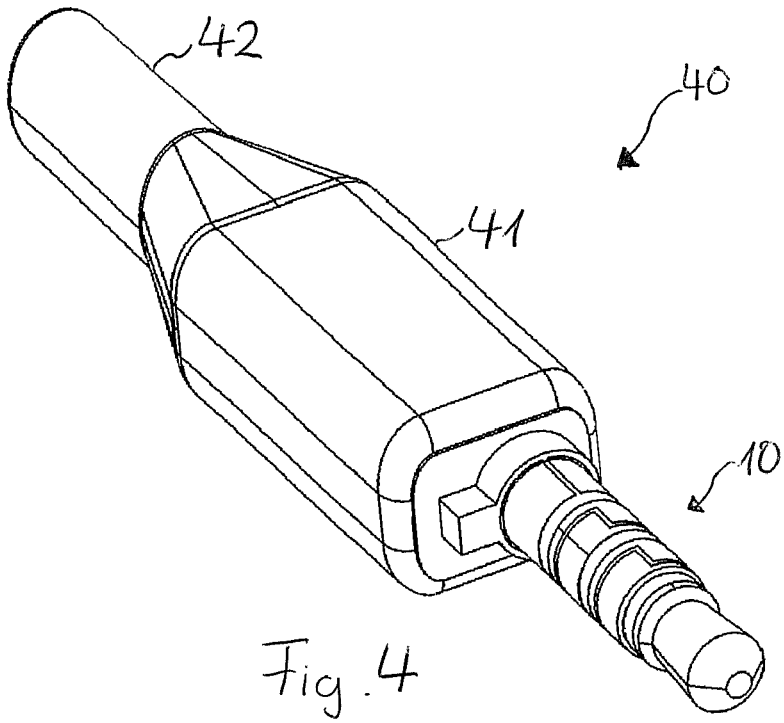
FIG. 4 shows the connector arrangement of FIG. 1 with a housing and a cable attached thereto according to an embodiment.

In FIG. 1, a connector arrangement 10 according to an embodiment of the present invention is shown. FIGS. 2 and 3 show portions of the embodiment of FIG. 1, and FIG. 4 shows the connector arrangement 10 incorporated in a connector 40 according to an embodiment.

The connector arrangement shown in FIG. 1 apart from portions 31, 32 which will be described later has the form of a standard TRRS (tip ring ring sleeve) connector, for example the form of a 3.5 mm connector, a 2.5 mm connector or a 6.35 mm connector. However, the connector arrangement of FIG. 1 has more individual contact elements, i.e. elements which may individually serve for transmission of signals, than conventional TRRS connectors.

Connector arrangement 10 of the embodiment of FIG. 1 comprises a tip portion or tip contact 11. Tip contact 11 may be electrically contacted via a rod-like portion 12 which is electrically coupled with tip contact 11. For example, tip contact 11 and rod-like portion 12 may be made of a metal or other conducting material.

Tip contact 11 is insulated via an insulating portion 25 from a first ring area which comprises a contact element 13, a contact element 19 and an insulator 26 electrically insulating contact elements 13 and 19 from each other. Contact element 13 may be electrically contacted via a contact portion 14, and contact element 19 may be electrically contacted via a contact portion 20. Contact elements 13 and 19 as well as portions 14 and 20 may be made of a metal, while insulator 26 may be made of a plastic material. On the surface of connector arrangement 10, as can be seen, portions of insulator 26 run parallel to insulator 25, i.e. parallel to a boundary of the first ring area, but other portions of insulator 26 run perpendicular to the direction of insulator 25, i.e. run parallel to a longitudinal axis of connector arrangement 10. First ring portion is insulated by a ring-shaped insulator 27 which may again be made of a plastic material from a second ring portion, the second ring portion comprising a contact element 15 which may be electrically contacted via a contact portion 16, a contact element 21 which may be electrically contacted via a contact portion 22 and an insulator 28 electrically insulating contact element 15 from contact element 21. Generally, the configuration of the second ring area comprising contact elements 15, 21 and insulator 28 is similar to the configuration of first ring area comprising contact elements 13, 19 and insulator 26 and will therefore not be described again in detail.

The second ring area is separated by an insulator 29 from a sleeve area (which also has a ring form and therefore may also be regarded as a ring area) comprising a contact element 17, a contact element 23 and an insulator 30. Ring-shaped insulator 29 and insulator 30 may be made of plastic and may be formed jointly, and contact elements 17 and 23 may be made of a metal. Contact element 17 may be electrically contacted via a contact portion 18, and contact element 23 may be electrically contacted via a contact portion 24. In the embodiment of FIG. 1, insulator 30 (which is also provided on the opposite side of connector arrangement 10 which is not visible in FIG. 1 in order to provide a complete insulation between contact elements 17 and 23) runs perpendicular to insulator 29, i.e. insulator 29 runs in a circumferential direction, and insulator 30 runs in a longitudinal direction of connector arrangement 10.

Furthermore, connector arrangement 10 of the embodiment of FIG. 1 comprises a ring portion 31 with a protrusion 32 which both may be made of an insulating material, for example a plastic material. Protrusion 32 facilitates orientating connector arrangement 10 correctly when connector arrangement 10 is inserted in a corresponding receptacle, an example for which will be described further below with respect to FIG. 5.

In an embodiment, tip contact 11, contact element 13 of the first ring area, contact element 15 of the second ring area and contact element 17 of the sleeve area may be used for the same purpose as a conventional TRRS connector, i.e. for stereo audio with an additional signal, for example a video signal. Contact elements 19, 21, and 23 may be used to transmit additional signals, for example to provide an additional power supply, to provide a contact for an antenna and/or to transmit data. However, the use of connector arrangement 10 of the embodiment of FIG. 1 or of other embodiments of the present invention is not limited to these signals, and the contact elements 13, 15, 17, 19, 21 and 23 and tip contact 11 may be used to establish an electrical connection for any desired kinds of signals.

The arrangement of the conducting portions of connector arrangement 10, which may for example be made of metal, are depicted in FIGS. 2 and 3 without the insulating portions. In FIG. 2, the portions defining tip connector 11, contact elements 13, 15, 17 and portions 12, 14, 16 and 18 are shown. As can be seen, the contact elements and contact portions for contacting them are arranged in a shell-like manner with the rod portion 12 in the center and portions 14, 16 and 18 surrounding rod portion 12 in a shell-like manner with an almost semicircular cross section (semicircular apart from spacing needed to be distanced from portions 20, 22 and 24) in this embodiment. Contact elements 13 and 15 in the embodiments shown comprise ring-shaped portions. In the embodiment shown, rod portion 12 is connected to tip portion 11 by extending the rod portion throughout the connector, and contact portions 14, 16 and 18 are connected with contact elements 13, 15 and 17 by extending the respective contact portions 14, 16 and 18 through the connector up to the respective contact elements 13, 15 and 17.

In a similar manner, in FIG. 3 a perspective view of contact elements 19, 21 and 23 as well as of contact portions 20, 22 and 24 are shown. In the embodiment depicted, contact elements 19 and 21 comprise ring portions. Contact portions 20, 22 and 24 are arranged in a shell-like manner with an almost semicircular cross section and extend to the respective contact elements 19, 21 and 23 for electrically contacting the same.

In an embodiment, for manufacturing connector arrangement 10 of FIG. 1, the portions shown in FIG. 2 and FIG. 3 are placed together in an injection molding form and are then overmolded with a plastic material for forming the insulating portions 25, 26, 27, 28, 29 and 30 and/or portions 31, 32. The ring portions of contact elements 13, 15, 19 and 21 shown in FIGS. 2 and 3 facilitate the placement of the conducting elements in such an injection molding form. In such an injection molding process, insulating material is also filled in between contact portions 12, 14, 16, 18, 10, 22 and 24 in order to surely insulate them from each other. In such an embodiment, all insulating portions of the connector arrangement may be molded as one piece. Also, in other embodiments, all insulating portions may be provided as one single piece. However, in yet other embodiments, some or all of the insulating portions may be provided as separate pieces. Furthermore, the above-explained method of injection molding serves only as an example, and other manufacturing methods, for example a separate manufacturing of an insulation part and the combination with conducting parts thereafter, is equally possible.

In FIG. 4, a plug 40 incorporating connector arrangement 10 explained with reference to FIGS. 1-3 is shown. Plug 40 comprises a housing 41 at an end of which connector arrangement 10 is mounted, and a cable 42 comprising a plurality of wires (not shown since they are within cable 42) for electrically contacting connector arrangement 10. For example, the wires may be soldered or otherwise electrically connected with contact portions 12, 14, 16, 18, 20, 22 and 24.

Figure 5:
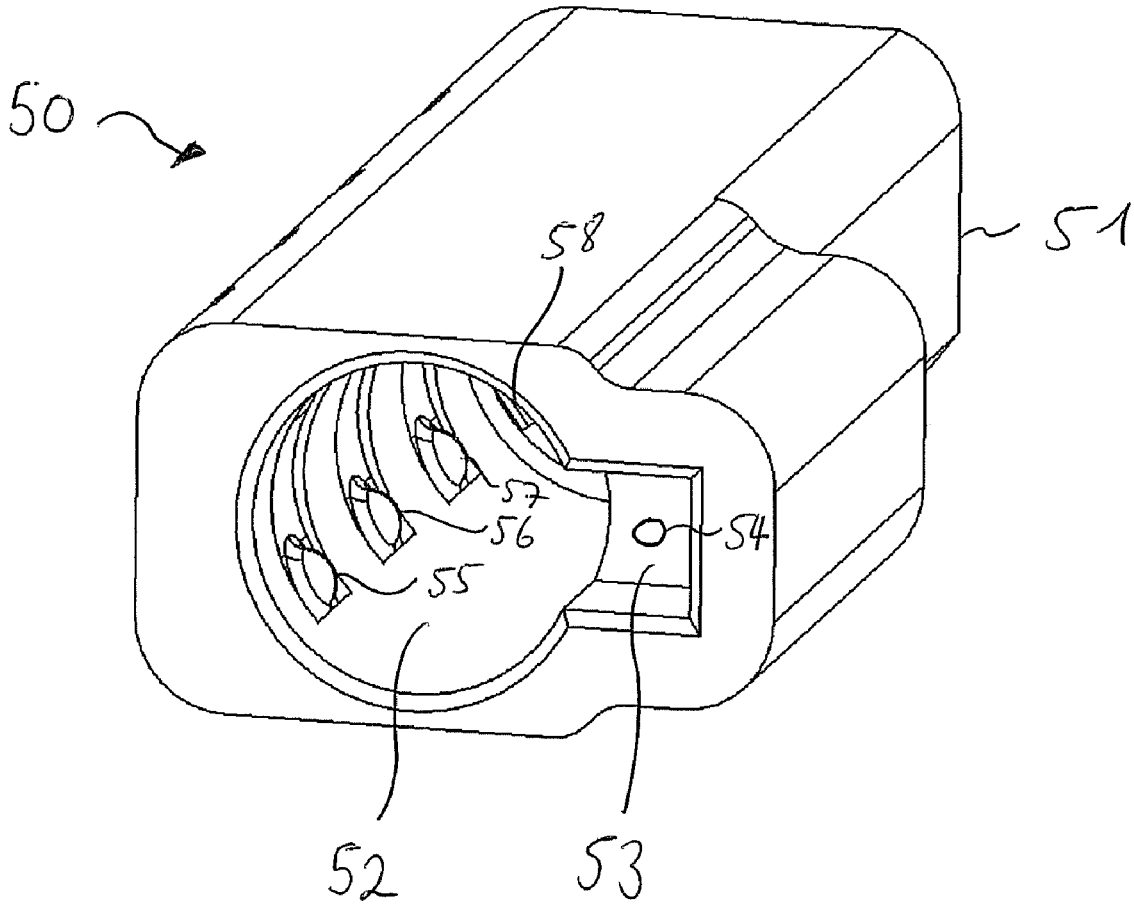
FIG. 5 shows a receptacle for a connector arrangement according to an embodiment.

In FIG. 5, a receptacle 50 according to an embodiment of the present invention for receiving a connector arrangement according to an embodiment of the present invention, for example connector arrangement 10 shown in FIG. 1, for example incorporated in plug 40 shown in FIG. 4, is shown. Receptacle 50 shown in FIG. 5 comprises a housing 51. Housing 51 may be part of a housing of an electronic device, for example a portable music player, a mobile phone, a laptop computer or a personal digital assistant (PDA). Housing 51 comprises an elongate hole 52 for receiving the connector arrangement and a cut-out 53 for receiving a protrusion of the connector arrangement, for example protrusion 32 of the embodiment of FIG. 1, to ensure the correct orientation of the connector arrangement. Within elongate hole 52, contacts are provided corresponding to the contact elements of the connector arrangement. For example, in the embodiment of FIG. 5 four contacts 55, 56, 57 and 58 are at least partially visible. When the connector arrangement 10 shown in FIG. 1 is inserted in receptacle 50, contacts 55, 56 and 57 contact elements 23, 21 and 19, respectively, to establish an electrical connection and contact 58 may contact tip contact 11 to establish an electrical connection. Further contacts which in the perspective view of FIG. 5 are not visible and may for example be arranged opposed to contacts 55, 56, 57 in elongate hole 52 serve for contacting contact elements 17, 15 and 13 to establish electrical contact therewith.

In an embodiment, as explained above and is shown in FIG. 1 the connector arrangement has the form of a standard audio connector, for example a standard 3.5 mm audio connector. In such a case, a corresponding receptacle like receptacle 50 of FIG. 5 may comprise some sensor 54, for example a mechanical sensor or an optical sensor, to detect the presence of protrusion 32 or a similar protrusion within cut out 53. In case a conventional audio connector is inserted in the receptacle, sensor 54 does not detect the presence of a protrusion, and for example only those contacts of contacts 55, 56, 57, 58 and possibly other contacts provided with elongated hole 52 may be activated which serve for establishing a standard audio or video connection as described in the introductory portion are activated. If, on the other hand, the presence of a protrusion is detected, all contacts may be activated to make use of all the contact elements provided on the contact arrangement.

It should be noted that instead of providing a sensor like sensor 54, the type of audio connector, i.e. conventional audio connector or audio connector according to an embodiment, may be detected by sending specific signals on specific contacts and receiving a corresponding response from the connected device, for example ear phone or loudspeaker, coupled to the connector arrangement.

The above-described embodiments serve only as examples, and a plurality of variations are possible without departing from the scope of the present invention. For example, while in the embodiment of FIG. 10 a tip portion, a first ring portion, a second ring portion and a sleeve portion are provided for responding to the form of a TRRS-connector, in other embodiments only a single ring portion or no ring portion may be provided.

Figure 1A:
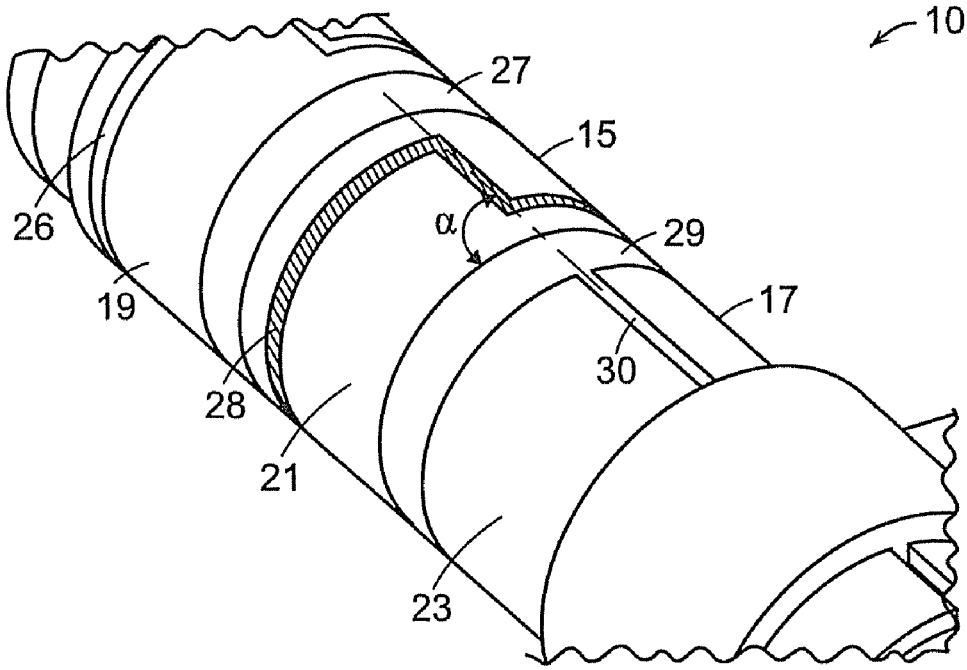
FIG. 1A is an enlarged partial sectional view of the connector arrangement of the embodiment of FIG. 1.

Furthermore, while in the embodiment of FIG. 1 insulators 26, 28 and 30 run either parallel to the insulating portions 25, 27, 29, i.e. parallel to the boundaries of the ring areas, or perpendicular thereto (see, for example, angle $\alpha$ between the insulator 28 and the insulating portion 29 in FIG. 1A), in other embodiments portions of the insulators separating the contact elements within a ring area or within the sleeve area may comprise portions forming any other non-zero angle with the boundary of the ring portions and sleeve portions, respectively. In other embodiments, more than two contact elements may be provided within a ring area or within a sleeve area by providing corresponding insulations.

While in the embodiment of FIG. 1 the first ring area and the second ring area are designed in a similar manner regarding the positioning of the insulating portion and the partitioning in contact elements, in other embodiments different partitionings and positions and form of the insulating portions may be used.

In an embodiment, also tip contact 11 may be partitioned in two or more contact elements using an insulator. While in the embodiment of FIG. 1 connector arrangement 10 has the form of a standard audio connector, in other embodiments other forms corresponding to an elongate member having a ring area may be used. For orientating connector arrangement 10, in FIG. 1 a protrusion 32 is shown. In other embodiments, the protrusion may have another form, more than one protrusion or other ridge or wedge-like members may be provided, or also a slit or groove matching with a corresponding protrusion in a receptacle may be provided. The electrical contact to the contact elements of the connector arrangement may be ensured in a different way than explained with reference to FIGS. 2 and 3, for example via wires soldered to the contact elements.

In an embodiment, protrusion 32 may be removable in order to be able to insert connector arrangement 10 in a standard audio connector socket.

A receptacle like receptacle 50 may be modified corresponding to the modification discussed above for the connector arrangement in order to match with the connector arrangement and be able to receive and electrically contact the same.

As can be seen, numerous modifications are possible, and therefore the present invention is not limited to any specific embodiment, but is intended to be limited only by the appended claims and equivalents thereof.

What is claimed is:

1. A connector arrangement, comprising:

an elongate member with a first end having a tip and a second end, said elongate member comprising:

at least one ring area formed on a surface of the elongate member and electrically insulated from another surface of the elongate member by a ring-shaped insulator, said at least one ring area comprising at least a first contact element, a second contact element, and an insulation within a part of the at least one ring area formed on the surface of the elongate member that electrically insulates the first and second contact elements from each other, wherein at least a portion of the insulation between the first contact element and the second contact element runs in a direction forming an angle with a direction of a boundary of the at least one ring area between the at least a portion of the insulation and the ring shaped insulator.

2. The connector of claim 1, wherein the elongate member has the form of a standard audio connector.

3. The connector of claim 2, wherein the standard audio connector is selected from the group consisting of a 3.5 mm audio connector, a 2.5 mm audio connector and a 6.35 mm audio connector.

4. The connector of claim 1, further comprising a plurality of ring areas formed on the surface of the elongate member.

5. The connector of claim 4, wherein said plurality of ring areas comprises a first ring area, a second ring area and a third ring area, said third ring area being arranged at said second end of said connector to form a sleeve area, each of said first ring area, second ring area and third ring area comprising a first contact element and a second contact element.

6. The connector of claim 1, further comprising a tip contact at said first end.

7. The connector of claim 1, wherein said first contact element and said second contact element each comprise at least one ring-shaped portion.

8. The connector of claim 1, further comprising a guiding element configured to aid an insertion of the connector arrangement into a receptacle with a defined orientation.

9. The connector arrangement of claim 8, wherein the guiding element comprises a protrusion.

10. A connector assembly comprising: a receptacle and a connector arrangement, the receptacle comprising: an elongate hole; and at least two contacts arranged within said elongate hole to connect first and second contact elements of the connector arrangement, respectively, the connector arrangement including:

at least one ring area formed on a surface of the elongate member and electrically insulated from another surface of the elongate member by a ring-shaped insulator, said first and second contact elements of the connector arrangement being arranged within a ring section formed on a surface of said connector arrangement, and being separated from each other by at least a portion of an insulation within a part of the ring section formed on the surface of the elongate member that runs in a direction forming an angle with a direction of a boundary of the ring section between the at least a portion of the insulation and the ring shaped insulator.

11. The receptacle of claim 10, further comprising a guiding element configured to provide a defined orientation for the insertion of the connector arrangement into the receptacle.

12. The receptacle of claim 11, wherein said guiding element comprises a cut-out.

13. The receptacle of claim 11, further comprising a sensor configured to detect coupling of a further guiding element of a connector arrangement with said guiding element.

* * * * *

UNITED STATES PATENT AND TRADEMARK OFFICE

CERTIFICATE OF CORRECTION

PATENT NO. : 8,206,181 B2
APPLICATION NO. : 12/431798
DATED : June 26, 2012
INVENTOR(S) : Johan Magnus Rikard Steijner It is certified that error appears in the above-identified patent and that said Letters Patent is hereby corrected as shown below:

In the Claims:

In Claim 11, Col. 8, line 36:

Please replace “receptacle” with --connector assembly--.

In Claim 12, Col. 8, line 39:

Please replace “receptacle” with --connector assembly--.

In Claim 13, Col. 8, line 41:

Please replace “receptacle” with --connector assembly--.

Signed and Sealed this
Second Day of October, 2012

David J. Kappos
*Director of the United States Patent and Trademark Office*